United States Patent [19]

Platt

[11] 4,296,858

[45] Oct. 27, 1981

[54] TWO-WAY CONTAINER PACKAGE

[75] Inventor: John R. Platt, Wheaton, Ill.

[73] Assignee: Illinois Tool Works Inc., Chicago, Ill.

[21] Appl. No.: 103,772

[22] Filed: Dec. 14, 1979

Related U.S. Application Data

[63] Continuation-in-part of Ser. No. 40,620, May 21, 1979, abandoned.

[51] Int. Cl.[3] ..... B65D 75/00

[52] U.S. Cl. ..... 206/150; 206/139; 206/427; 206/216

[58] Field of Search ..... 206/150, 141, 149, 427, 206/139, 428, 216

[56] References Cited

U.S. PATENT DOCUMENTS 3,734,278 5/1973 Kerrigan et al. ..... 206/150
3,750,874 8/1973 Detzel et al. ..... 206/141
4,185,744 1/1980 Peterson ..... 206/427
4,191,290 3/1980 Suffern ..... 206/150

*Primary Examiner*—Joseph Man-Fu Moy
*Attorney, Agent, or Firm*—Thomas W. Buckman

[57] ABSTRACT

A package for a plurality of containers having retained pull-tab openers. The package comprises a primary package for handling such containers when in the full condition, as well as a secondary package permitting users of the containers to repackage them when empty. A flat sheet member is secured by tabs which lock over an array of containers which have been packaged utilizing a thermoplastic-type packaging device. The flat sheet member includes tabs which lock the member to finger holes in the thermoplastic device. This sheet member further includes particularly designed slots, equal in number to the number of containers packaged, which lock the retained tabs in the sheet for efficient handling and return of empty containers.

3 Claims, 8 Drawing Figures

TWO-WAY CONTAINER PACKAGE

CROSS-REFERENCE TO RELATED APPLICATIONS

This application is a continuation-in-part of my application Ser. No. 6/040,620, filed May 21, 1979, now abandoned.

BACKGROUND AND SUMMARY OF THE INVENTION

This invention is concerned generally with a package for a plurality of can-type containers having retained pull-tab lids. The invention is more particularly concerned with devices which repackage empty containers into an array so they are secured to a secondary package making device effectively against inadvertent removal.

Primary carrier devices of the type generally shown in U.S. Pat. Nos. 2,874,835–3,874,502 and 3,733,100 are widely known and accepted multi-packaging devices. However, recently a need has arisen for some manner of repackaging empty containers of the type packaged in these carrier devices. Two-way packages of this general type are shown in co-pending application Ser. No. 31232.

It is a primary object of this invention to provide a package which not only incorporates a primary package but a secondary package making device which efficiently handles a plurality of cans having retained tear-tab openers.

A further object of the invention is the creation of a package which includes a flat sheet overlay member reliably secured to finger-holes in thermoplastic ring-like carrier devices.

A particular advantage of this invention is the incorporation of certain features in a flat sheet overlay member which serve to positively lock the retained tear-tabs of the container to the sheet member to create an efficient, reliable secondary package.

It is contemplated that the primary package will incorporate thermoplastic carrier devices of the type generally described in the above three U.S. patents, in addition to a sheet member secured by locking tabs inserted in the finger holes of these carriers.

Other important features of the present invention include tabs formed in the sheet member designed to positively lock the overlay member in finger holes of the thermoplastic carrier using locking surface above and below the margins of the finger holes.

Other objects and advantages of the invention become apparent from the following description and accompanying drawing wherein

DETAILED DESCRIPTION OF THE PREFERRED EMBODIMENT

Figure 1:
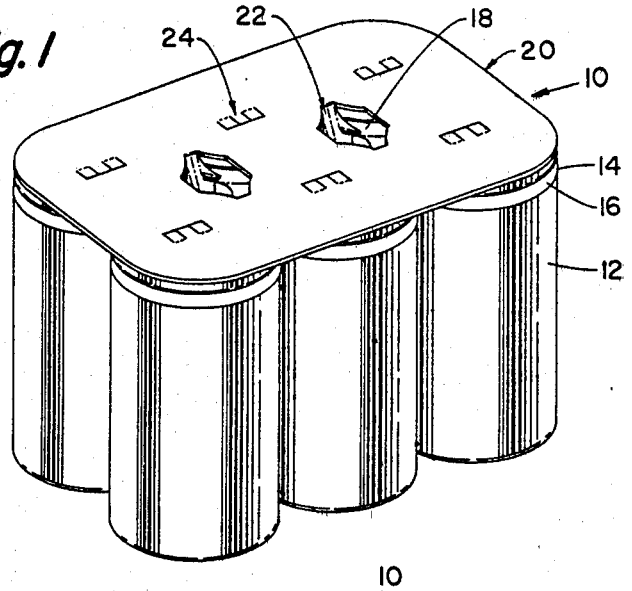
FIG. 1 is an isometric view of the two-way container package in its primary packaging mode according to one embodiment of the invention.

Turning first to FIG. 1, a package 10 can be described as including a plurality of can-type containers 12 primarily packaged by a thermoplastic carrier device 14 and including a sheet-like member 20 secured to the carrier device to overlay the containers.

The carrier device 14, typical of prior art devices of this type, will include a plurality of finger receiving apertures 18, having predetermined dimensions, and a plurality of bands 16 incorporating container receiving apertures.

The sheet member 20 is preferably of a cardboard material, but can be of any suitable sheet material, such as plastic, and will include tabs 22 positioned to overlie and register with the apertures 18 in the carrier. As will be described later herein, the tabs are configured to effectively lock into the finger holes. The sheet member further includes a plurality of slots 24 positioned to generally overlie the center of each container. The number of these slots should equal the number of containers 12 being packaged.

Figure 2:
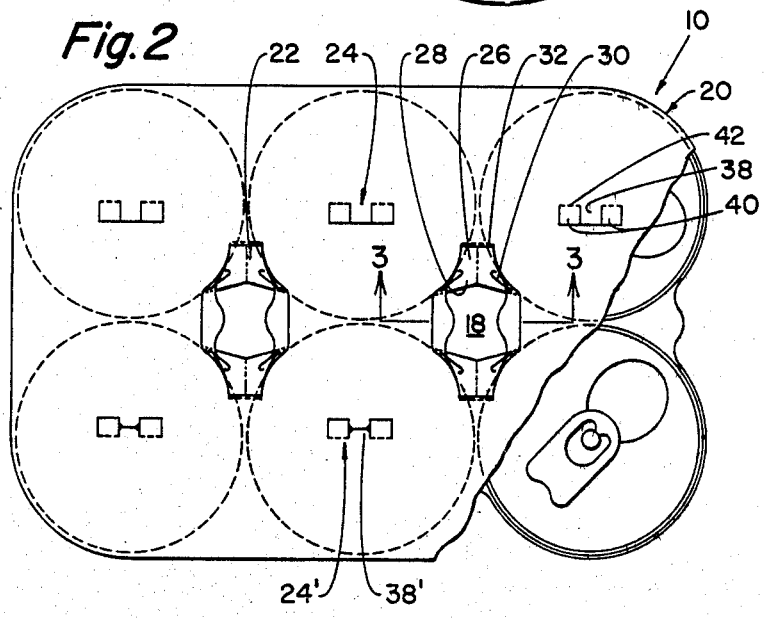
FIG. 2 is a partial top plan view of the preferred embodiment of the package shown in FIG. 1.
Figure 3:
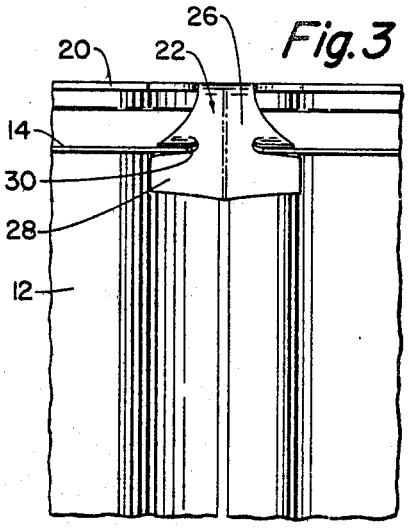
FIG. 3 is a cross-sectional view taken along the lines 3—3 of FIG. 2 shown in the tab configuration which securely locks the overlay to the plastic carrier device.

Attention is now directed to FIGS. 2 and 3 which will show in more detail the configuration of the tabs 22 which lock the sheet to the carrier as well as certain features of slots 24, which lock the retained tabs of containers to the sheet in a secondary packaging mode.

Tabs 22 are typically formed in opposing pairs and are adapted to bend downwardly from a bend line 32 through the aperture 18 created by the finger hole. The tab is configured to have slits 30 extending inwardly from the region of maximum transverse dimension with the slits spaced upwardly from the free extremity of the tab. The tab will have a length from the bend line to the free extremity sufficient to be inserted downwardly to anchor beneath the margin of the aperture 18. More importantly, it should be noted that slits 30 produce a positive locking effect by creating lower tab portion 28 of the tab which is locked against the lower surface of the carrier and an upper portion 26 of the tab which is locked against the upper surface of the carrier. This structure enhances the primary package by covering the lids, permitting the finger holes to be utilized without accidentally disassociating the sheet from the package.

Figure 4:
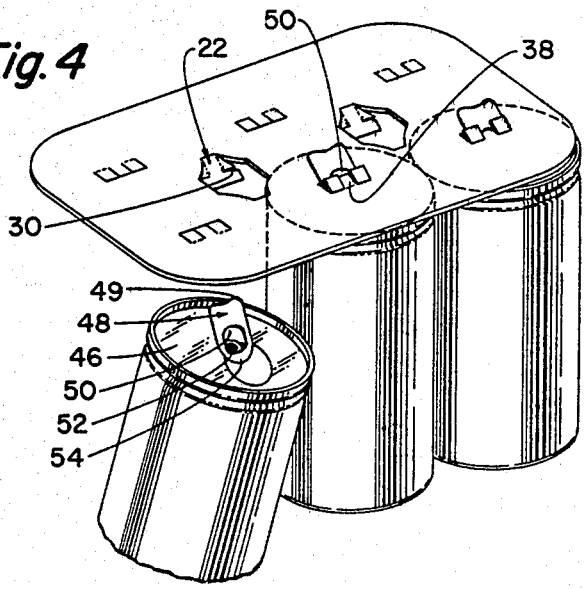
FIG. 4 is an isometric view showing the creation of the secondary package embodied in the primary package of FIG. 1.

As noted above, the secondary package making device 20 is particularly designed to accommodate containers which have retained tear tabs. With this in mind, reference to FIG. 4 will show such a container having a lid 46, with a tear tab 48 secured to the center of the lid. The tear tab will include an aperture 50, a connection region 52 which permits the container to be opened by pivoting the nose portion 54 downwardly relative to the connection upon exertion of an upward force on the lever region 49.

This invention utilizes the short strut created between the nose of a retained tab and its connection to the can lid as well as the aperture in the retained tab as various forms of techniques to securely lock empty cans to a secondary package making sheet member.

Slots 24, in the preferred embodiment will include a plurality of flaps. As shown in the upper line of slots 24 in FIG. 2, a pair of outer flap members 40 are designed to bend about a bend line 42 while a centermost flap or strut 38 is adapted to snap into the aperture 50 of the retained tab after it has been inserted upwardly through the slot 24. A viewing of FIG. 4 will illustrate the effect of the cooperation between the center flap 38 and the aperture 50 created by the tear tab. Strut 38 will, since it is not provided with a bend line, snap back through the aperture and extend substantially completely across the narrow width of the slot. The length of the slot 24 should generally be the width of the tear tab.

It should be understood that many alternatives to the locking arrangement created by the center posts 38 can be developed to achieve the same result. It should also be understood that the outer flaps 40 formed could emanate from the sides of the slot opposite the side which is connected to center flap 38. It should also be apparent that outer flaps 40 could be eliminated entirely without effecting the locking cooperation between aperture 50 and center flap 38. Other modifications to the locking arrangements described herein may become necessary due to various styles of retained tab members on cans. For example, the lower line of slots 24' in FIG. 2, shows a pair of opposed inwardly directed posts 38'. Such a configuration may more readily snap into smaller apertures in retained tabs because of the shorter length of each post 38'.

Figure 5:
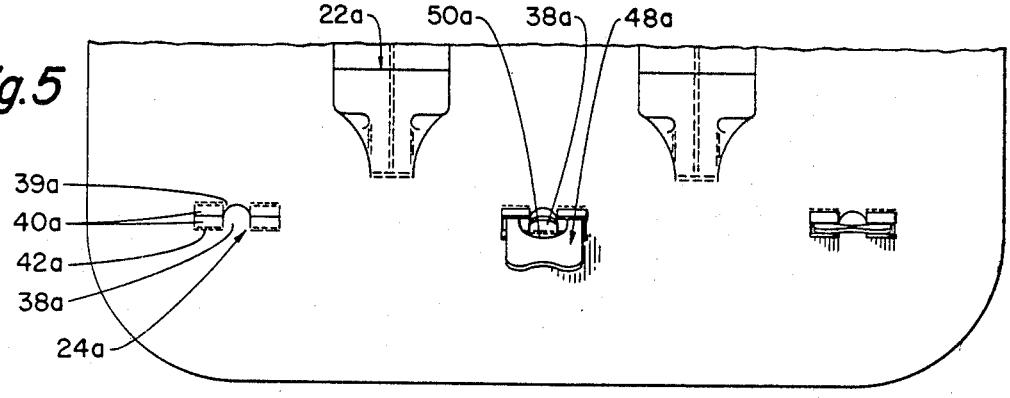
FIG. 5 is a partial plan view of an alternate embodiment of the secondary packaging device of the invention showing a different form of slots to lock the empty containers to the secondary package.

FIG. 5 shows a somewhat different embodiment of the invention wherein sheet **20*a* is configured with a plurality of slots 24*a* having center flap member 38*a* and outer flap member 40*a* adapted to bend about bend lines 42*a*. However, it should be noted that instead of a single center flap, a pair of opposed flaps acting together create the locking effect desired. The center post 38*a* may be rounded at its extremity and a short transversely aligned strut 39*a* with a concave extremity extends from the opposing side of the slot 24*a*. This configuration provides additional frictional resistance to the retained tab 48*a* in addition to providing a plurality of abutment surfaces for the aperture 50*a* to react against. The three slots from left to right in FIG. 5 show the slot before the tab is inserted, the slot as the tab is being inserted and the slot locking the tab in the secondary package. Outer flaps 40*a* are pairs of opposing flaps rather than a single flap as in FIG. 2**.

Figure 6:
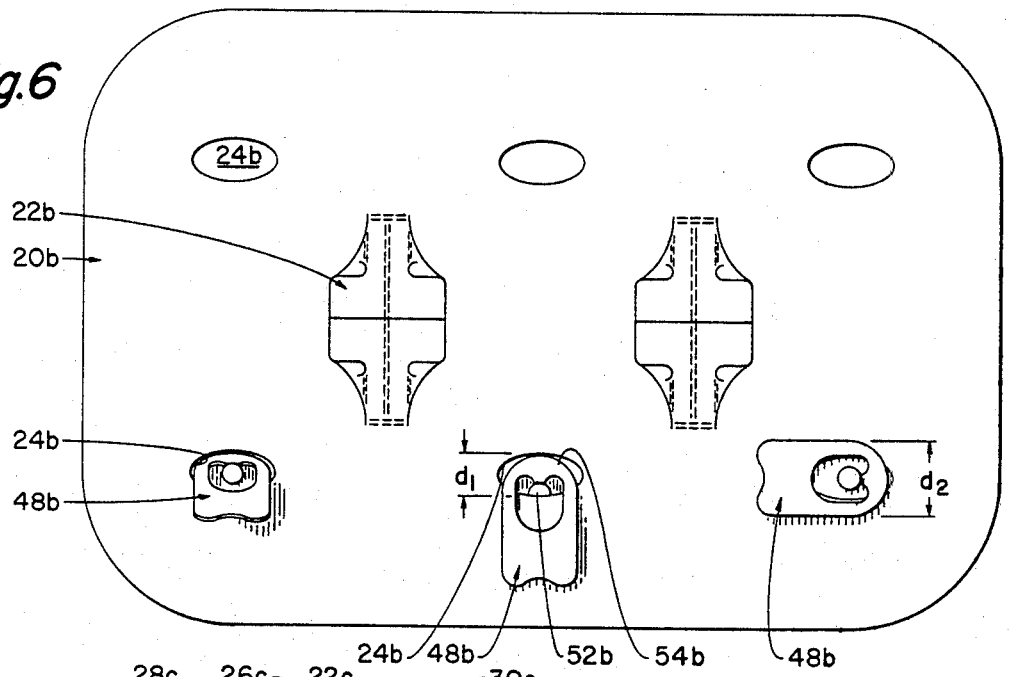
FIG. 6 is a plan view of yet another embodiment of the invention showing another form of slots to lock empty containers to the secondary package.

FIG. 6 shows yet another alternate structure of slots to lockingly accommodate the tear tab retained. Oval slots **24*b* are provided with a maximum dimension substantially equal to the width of the tab and a minor dimension less than the width of the tab but greater than the dimension between the connection 52*b* and the nose region 54*b* of the tab. The dimension between 52*b* and 54*b* denoted as $d_1$ and the width of the tab 48*b* is denoted as $d_2$. In operation, the tear tab 48*b* is inserted through the aperture 24*b* and the nose 54*b* is free to clear the minor dimension oval slot. The tab 48*b* is pushed downwardly and then rotated approximately 90° relative to the sheet 20*b* so that the width of the tab overlies the minimum dimension of the aperture 24*b* thus locking the container in the secondary package. Reference to three slots in the lower region of the figure shows the three-step operation of the locking. The tab 48*b* is first inserted through the aperture 24*b* followed by a moving of the nose 54*b* up clearing the aperture and finally a rotation of the tab 48*b* to overlie the margins of the oval hole. The upper line of apertures 24*b*** illustrates the hole prior to insertion of the tab.

Figure 7:
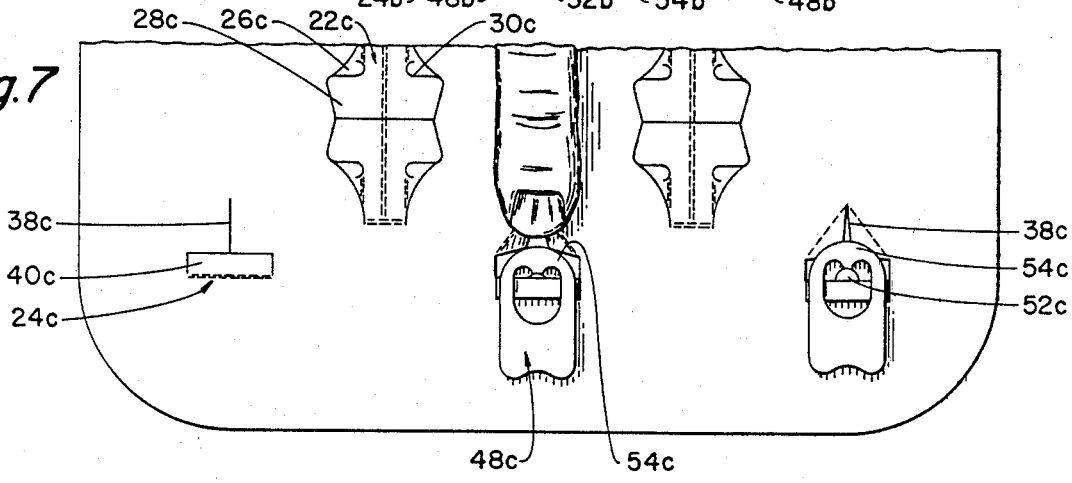
FIG. 7 is a partial plan view of a further embodiment of the invention showing a different configuration of the tab to lock a sheet member to the carrier as well as another form of slots to lock empty containers.

FIG. 7 shows another embodiment of the tab which locks the overlay to the carrier in a primary package. Tab **22*c* is substantially identical to that of the other embodiments except it has an upwardly and outwardly tapering lower region 28*c* which facilitates the camming downwardly of that region so that slit 30*c* may lockingly engage an associated carrier device with an upper region 26*c* and lower region 28*c***.

The slots **24*c* show a single flap 40*c* with a slit intersecting the slot generally at right angles to its maximum dimension and equidistant between the extremities. This slot 38*c* creates a locking arrangement by permitting the nose region 54*c* to clear after the tab has been forced down much like the second step of the embodiment shown in FIG. 6. A slight depression by a user's finger of the region adjacent the slot 38*c* will expand the lateral dimension permitting the nose 54*c* to clear. Once the nose portion 54*c* is above the plane of the sheet, the triangular flaps created by the slit 38*c*** will provide adequate resistance to the movement of the nose section downwardly, thus a positive abutment is formed, which is effective to lock the cans from inadvertent removal when they are being repackaged.

Figure 8:
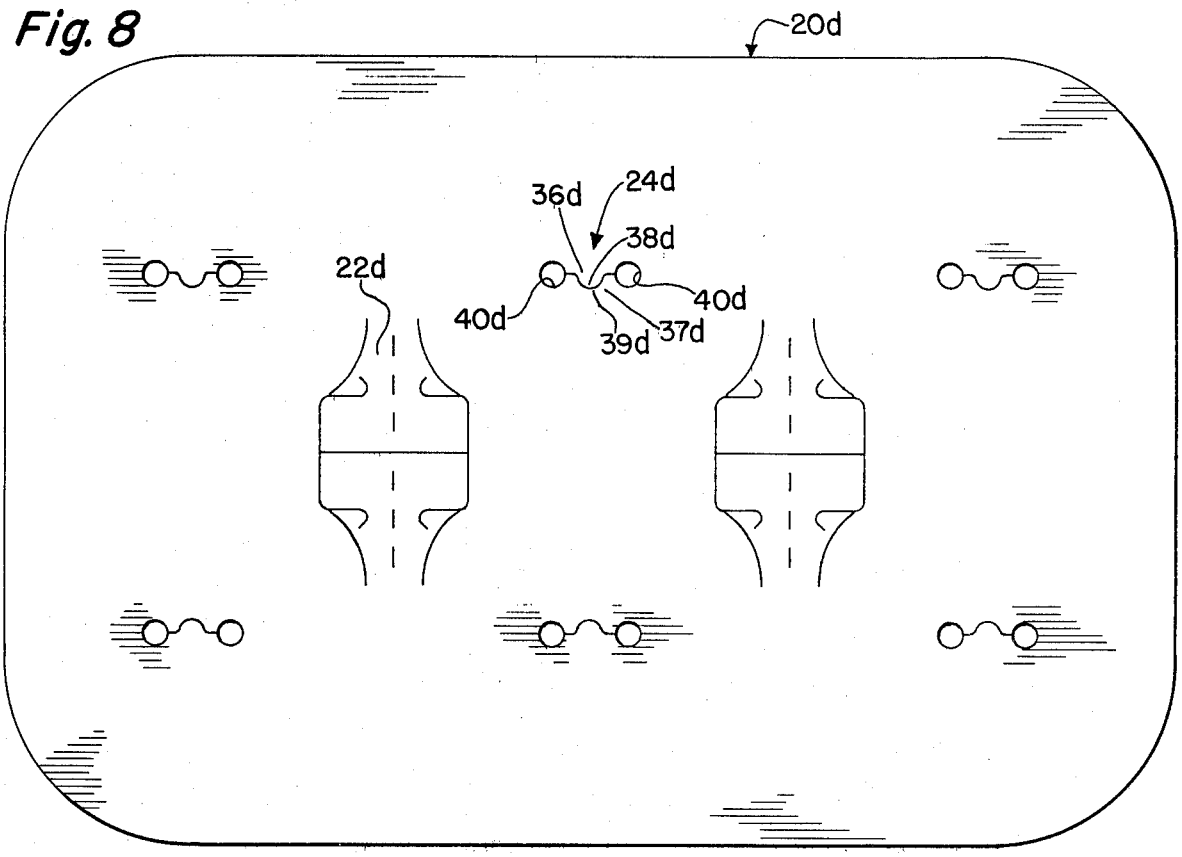
FIG. 8 is a plan view of another embodiment of the invention showing another form of slots to lock empty containers to the secondary package.

FIG. 8 shows yet another embodiment of an overlay incorporating slots designed to accommodate a range of sizes of apertures. Overlay **20*d* includes locking tabs 22*d* similar to those described in the above embodiments and a plurality of pull-tab retaining slots 24*d*. Slots 24*d* are particularly designed to accept and positively lock retained tab designs including at least two different size apertures. Apertures, such as 50 in FIG. 4, may be relatively small or relatively large and slots 24*d* accommodate both sizes. The longitudinal extremities of each slot 24*d* include through apertures, such as circular holes 40*d***.

The locking aspects of the slots **24*d* are provided by two different size posts 36*d* and 38*d* emanating from the same side of the slot with 38*d* being a continuation of 36*d*. The longer length dimension of 36*d* permits the larger apertured pull-tabs to be snugly locked on the array. The smaller length and width dimension of extension post 38*d* likewise permits the snug locking of a smaller apertured pull-tab. Complementary configured opposing post section 37*d* includes a recess 39*d* much like recess 39*a* in FIG. 5**.

It should be understood that one aspect of the invention is an overlay section which can be positively locked over the tops of containers which have been arrayed by a thermoplastic carrier. The overlay could further be used without the can return slots over a suitable array utilizing the novel locking tabs 22. It should be understood that while a package of six containers is shown, a package including any other plurality of containers can be covered and delineated with an overlay including the locking tab of this invention. For example, a package of 12 containers, as shown in U.S. Pat. No. 4,018,331, can be used in conjunction with this invention.

While the invention has been described in conjunction with several embodiments, it should be understood that it is not intended to limit the invention to those embodiments. On the contrary, it is intended to cover all alternatives, modifications and equivalents as may be included within the spirit and scope of the invention as defined by the appended claims.

I claim:

1. In a two-way package for can-type containers which have lids configured to include retained tear tab opening devices, the package including a predetermined plurality of such containers secured in an array by a thermoplastic strip device having a plurality of container carrying bands, each band surrounding, resiliently engaging and retaining a predetermined circumferential region of side wall of an associated container, said strip further including finger hole means of predetermined dimension and located within the outer perimeter of the package thus formed, a flat sheet-like member overlying the lids of the packaged array of containers, means for securing the sheet-like member to the package, a plurality of elongated slot means formed in the sheet-like member, the major dimension of said slot means being not less than the width of the retained pull-tab so that the tab may be inserted therethrough, the slot means further including means to lockingly retain the tabs to the sheet member after the tabs are inserted therethrough, the slot means being equal in number to the containers included in the array with each slot means spaced inwardly from the outer perimetrical margin of the sheet member and located so as to generally overlie the center of the lids of the associated containers when retained by the thermoplastic device, the retained tear tabs include an aperture formed therein, the means for lockingly retaining the tabs to the sheet member including a flap extending across the minor dimension of each slot means, the flaps having a width less than the major dimension of the slot means and not greater than the transverse dimension of the aperture in the retained tab, the length of the flap being substantially equal to the minor dimension of the slot means so the flap may snap into and through the aperture in the tab when the tab is inserted through the slot means, wherein the sheet member may be utilized to repackage the empty containers.

2. In a package for a plurality of can-type containers arranged in a predetermined array including a thermoplastic device having a plurality of can receiving apertures and resilient can engaging band means, finger hole aperture means formed through said thermoplastic device, said finger hole means being of a predetermined configuration and a first predetermined transverse dimension, the band means being located immediately below the intersection of the lid and the sidewalls of the container, a flat sheet member overlying the lids of the containers and having an outer margin substantially corresponding in configuration and dimension to the outer perimetrical margin of said array of containers, a tab means integrally formed on said sheet member adapted to be bent about a line from the plane of the sheet member downwardly into the finger hole aperture, the tab means having a predetermined length dimension, from the bend line toward its free extremity, and a predetermined maximum transverse dimension, slit means formed on the tab extending transversely of the tab inwardly generally from the region of maximum transverse dimension, the maximum transverse dimension being greater than the first predetermined transverse dimension of the finger hole aperture, whereby the tab may be pushed down through the finger hole aperture with the marginal edges of the aperture inserted in the slit means so the tab lockingly engages both the lower surface of the thermoplastic device and the upper surface.

3. In a device for packaging empty can-type containers having retained tear tab opening means, a sheet member having a predetermined outer marginal configuration and dimension, a plurality of slot means formed in said sheet and spaced inwardly from the margin of said sheet member, the slot means being equal in number to the number of containers to be packaged with the outer margin of the sheet member being configured and dimensioned so that all of the containers are retained in a closely spaced array beneath the sheet member and the array in composite presenting an outer perimetrical margin not greater in configuration or dimension that that of the sheet member, each slot means being elongated with a major dimension not less than the width of the tear tab opening means to be associated therewith so that the tab means may be inserted through the slot means, means integral with the sheet member and associated with each slot means for positively locking the tab means thereto, each slot means includes a flap located intermediate extremities of the major dimension, extending across the minor dimension of the slot means and adapted to snap into an aperture in an associated retained tear tab, and thus secure the container to the sheet member against inadvertent removal from the package thus formed.

* * * * *